US006137982A

United States Patent [19]

Margiotta

[11] Patent Number: 6,137,982

[45] Date of Patent: Oct. 24, 2000

[54] FUSER STRIPPER APPARATUS

[75] Inventor: Al Margiotta, Planview, N.Y.

[73] Assignee: Olympus America, Inc., Melville, N.Y.

[21] Appl. No.: 09/376,847

[22] Filed: Aug. 18, 1999

[51] Int. Cl.[7] ..... G03L 15/00; G03G 15/20

[52] U.S. Cl. ..... 399/323; 271/307; 271/900

[58] Field of Search ..... 399/322, 323, 399/398, 122; 271/311, 312, 900, 307

[56] References Cited

U.S. PATENT DOCUMENTS

| | | | |
|---|---|---|---|
| 3,824,011 | 7/1974 | Suzuki et al. | 399/398 |
| 3,992,000 | 11/1976 | Martin . | |
| 4,065,120 | 12/1977 | Imaizumi et al. . | |
| 4,224,872 | 9/1980 | Sato . | |
| 4,252,310 | 2/1981 | Konno et al. . | |
| 4,281,623 | 8/1981 | Kato et al. . | |
| 4,357,094 | 11/1982 | Zepko . | |
| 4,408,757 | 10/1983 | Yarm . | |
| 4,475,804 | 10/1984 | Kanno et al. . | |
| 4,487,158 | 12/1984 | Kayson . | |
| 4,748,473 | 5/1988 | Tsuruoka . | |
| 4,870,464 | 9/1989 | Itaya et al. . | |
| 5,053,830 | 10/1991 | Arai . | |
| 5,161,796 | 11/1992 | Okamoto . | |
| 5,181,076 | 1/1993 | Nishikawa . | |
| 5,309,209 | 5/1994 | Huh | 399/69 |
| 5,392,108 | 2/1995 | DeWaters et al. . | |
| 5,532,810 | 7/1996 | Cahill . | |
| 5,671,471 | 9/1997 | Mizuno et al. . | |
| 5,708,946 | 1/1998 | Cahill et al. . | |
| 5,729,798 | 3/1998 | Yasui et al. | 399/122 |

FOREIGN PATENT DOCUMENTS

| | | |
|---|---|---|
| 60-2972 | 1/1985 | Japan . |

*Primary Examiner*—Joan Pendegrass
*Attorney, Agent, or Firm*—Scully, Scott, Murphy & Presser

[57] ABSTRACT

A fuser stripper apparatus for use in a machine which imparts an image to paper being fed therethrough. The apparatus has: a fuser roller rotatably fixed in the machine and having a surface treated with a coating for effecting the impartation of the image to the paper, the fuser roller has at least one slot formed in its surface; an idler roller rotatably fixed in the machine which has a surface in substantial contact with the surface of the fuser roller thereby creating a nip for passage of the paper therein when either of the fuser or idler rollers are rotated; a motor for rotating one of the fuser or nip rollers; and a wire member disposed in each of the at least one slot formed on the surface of the fuser roller, the wire member has first and second ends fixed to the machine such that the paper is prevented from wrapping around the fuser roller by the wire member. In preferred embodiments, the machine is a printer, photocopier, or facsimile machine and the fuser stripper apparatus is contained in a removable component of the machine.

26 Claims, 4 Drawing Sheets

FUSER STRIPPER APPARATUS

BACKGROUND OF THE INVENTION

1. Field of the Invention

The field of art to which this invention relates is a fuser stripper apparatus for use in machines such as printers, facsimile machines, photocopiers, and the like, for preventing sheets and envelopes fed into the machine from wrapping around a fuser roller.

2. Description of the Related Art

In machines in which an image is imparted from a fuser roller to a sheet of paper or an envelope or the like, a common problem is preventing the paper from wrapping around the fuser roller and becoming jammed in the machine. Paper jams result in machine downtime and possibly, expensive maintenance. Additionally such a fuser roller is typically heated which adds to the wrap-around problem previously mentioned in that paper is more prone to curl when heated, especially treated paper or waxed paper having labels affixed thereto.

Stripper devices of the prior art attempt to solve the wrap around problem with fingers, claws, or pawls which are spring loaded toward a surface of the fuser roller to prevent paper fed thereto from wrapping around the fuser roller. While other stripper devices of the prior art use scraper blades urged against the fuser roller to prevent papers fed thereto from wrapping around the fuser roller.

While the prior art stripper devices are somewhat useful, they all suffer from the same disadvantages; they are generally complicated and expensive to fabricate. These stripper devices can also affect the quality of the reproduction because they are in rubbing contact with the surface of the fuser roller. More importantly, the stripper devices of the prior art are not foolproof. That is, as is commonly known, paper, envelopes, and sheets of labels still manage to get between the prior art stripper devices and the surface of the fuser roller to become jammed.

The problem with the prior art stripper devices is inherent in the way the prior art addresses the problem, namely, something is biased towards the surface of the fuser roller, typically with a spring. However, if the paper being fed over the fuser roller has a sufficient force to lift the device from the fuser roller surface, the device's effectiveness is lost. Of course, a spring having a great enough spring force can be used which would make it unlikely to be lifted away from the surface of the fuser roller. However, such a spring force would affect the rotation of the fuser roller, requiring greater torque to rotate it. Furthermore, such a force urging a stripper device against the fuser roller surface would certainly affect the ability of the fuser roller to impart the proper amount and pattern of toner in the area which contacts the stripper device and may even damage the coating on the fuser roller surface.

For these reasons a fuser stripper apparatus is needed which is simple, economical, does not affect a rubbing contact with the fuser roller and which substantially eliminates the possibility of paper jams from occurring due to wrap-around of the fuser roller.

SUMMARY OF THE INVENTION

Therefore, it is an object of the present invention to provide a fuser stripper apparatus which is simple and economical to implement.

It is a further object of the present invention to provide an fuser stripper apparatus which does not impart a rubbing contact with the surface of the fuser roller.

It is a further object of the present invention to provide fuser stripper apparatus which eliminates the need to urge a device against the fuser roller.

It is still yet another object of the present invention to provide fuser stripper apparatus which substantially eliminates the possibility of paper jams from occurring due to wrap-around of the fuser roller.

Accordingly, a fuser stripper apparatus for use in a machine which imparts an image to paper being fed therethrough is provided. The fuser stripper apparatus of the present invention comprises a fuser roller rotatably fixed in the machine. The fuser roller has at least one slot formed in its surface. The apparatus also has an idler roller rotatably fixed in the machine which has a surface in substantial contact with the surface of the fuser roller thereby creating a nip for passage of the paper therein when either of the fuser or idler rollers are rotated. The apparatus also has means for rotating one of the fuser or nip rollers and a wire member disposed in each of the at least one slot formed on the surface of the fuser roller. Each wire member has first and second ends fixed to the machine such that the paper is prevented from wrapping around the fuser roller by the wire member.

In preferred embodiments of the fuser stripper apparatus, the machine is a printer, photocopier, or facsimile machine.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENTS

Figure 1:
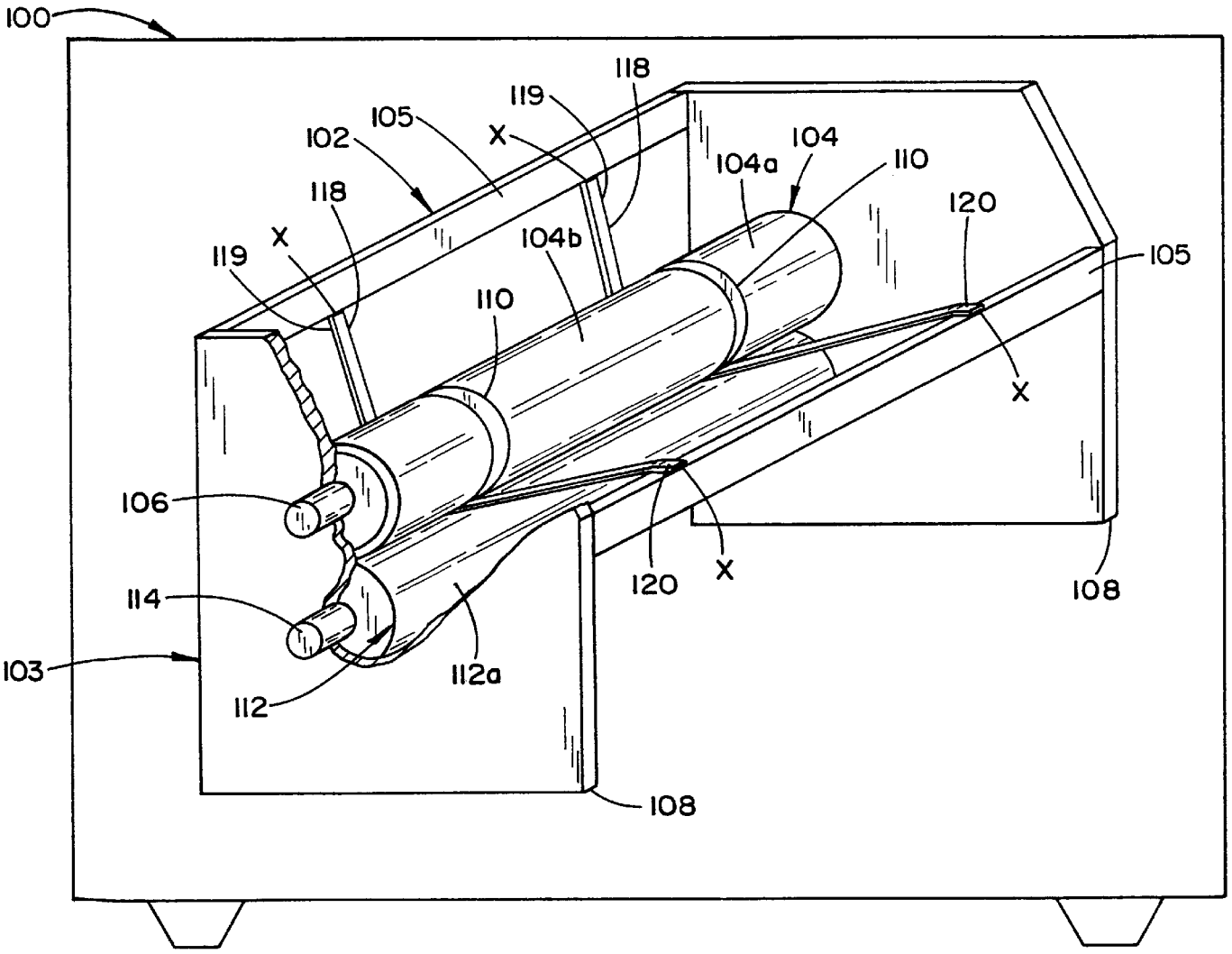
FIG. 1 illustrates a fuser stripper apparatus of the present invention wherein the wire members are fixed to a removable component of the machine.
Figure 3A:
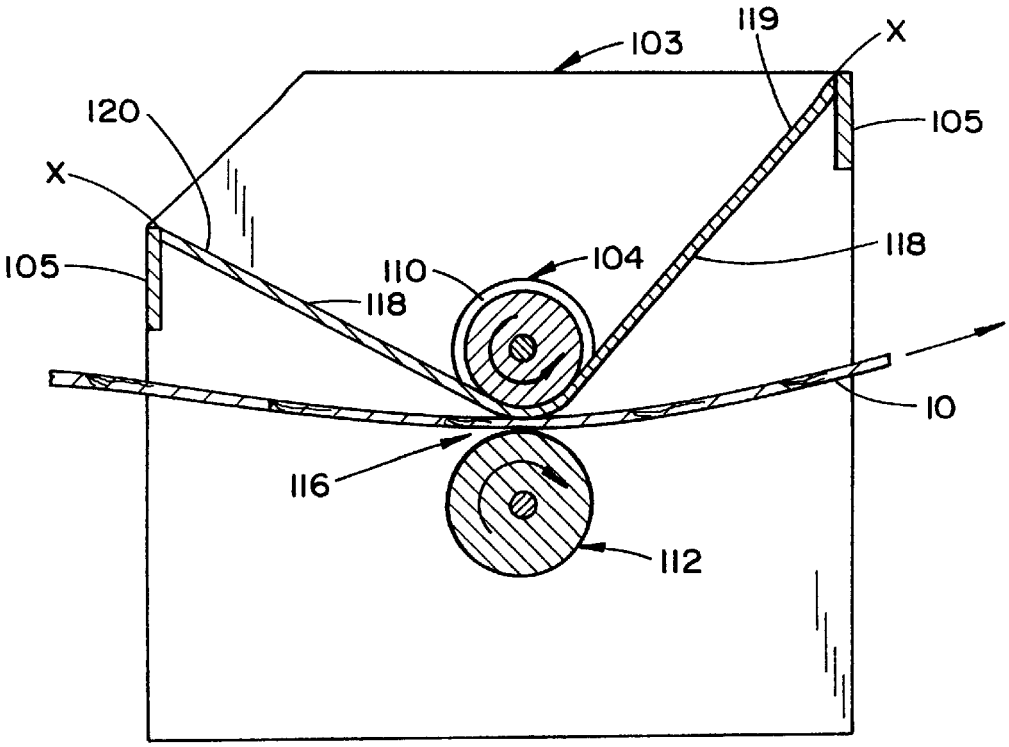
FIG. 3A illustrates a sectional view showing the fuser and idler rollers of the fuser stripper apparatus of FIG. 1.

Referring now to FIGS. 1 and 3A, there is illustrated a machine which imparts an image to paper 10 being fed therethrough, the machine being generally referred to by reference numeral 100. A fuser roller 104 imparts the image to paper 10 by applying toner from the fuser roller 104 with heat and pressure, as is known in the art. Examples of such machines 100 are printers, photocopiers, and facsimile machines.

The machine 100 has a fuser stripper apparatus 102 for preventing the paper 10 from wrapping around the fuser roller 104 thereby preventing the paper 10 from being jammed in the machine 100. Although, the present invention is discussed as preventing paper 10 from being jammed, it is understood that the present invention is equally applicable to envelopes, label sheets, transparencies and the like being fed into the machine 100. For purposes of the present invention, the term "paper" also means envelopes, label sheets, transparencies and any other item which can be fed into and printed upon by the machine 100.

The fuser stripper apparatus 102 comprises the fuser roller 104 which is rotatably fixed in the machine 100 by way of any means known in the art, such as by way of a shaft 106 disposed in a corresponding bore in a frame 103 of the machine 100. Alternatively, the fuser roller 104 is rotatably fixed in a removable component 108 of the machine. The fuser roller 104 typically has a useful life shorter than the machine 100 and is thus contained in a removable component 108 such that the fuser roller can be replaced at the end of its useful life. The fuser stripper apparatus 102 comprises all the elements necessary to achieve the objectives of the present invention, particularly, to prevent paper from wrapping-around the fuser roller. It should be apparent to those skilled in the art, that the machine 100 does not have to be configured such that the fuser stripper apparatus 102 is part of a removable component 108 of the machine 100, in which case the elements of the fuser stripper apparatus are fixed in the machine itself.

The fuser roller 104 typically has a heated surface 104*a* and is treated with a coating 104*b*, such as Teflon, for effecting the impartation of an image to the paper 10. The fuser roller 104 has at least one slot 110 formed in its surface 104*a*.

The fuser stripper apparatus 102 also has an idler roller 112 rotatably fixed in the machine 100 by way of any means known in the art, such as by way of a shaft 114 disposed in a corresponding bore in a frame of the machine 100. Alternatively, the idler roller 104 is also part of the removable component 108 and is rotatably fixed in a removable component 108 of the machine.

One of the fuser roller 104 or the idler roller 112 is rotated by a rotation means, such as a motor (not shown) rotatably connected to a corresponding shaft 106, 114. The idler roller 112 has a surface 112*a* in substantial contact with the surface 104*a* of the fuser roller 104 creating a nip 116 for passage of the paper 10 therein when either of the fuser roller 104 or idler roller 112 is rotated by the rotation means.

A wire member 118 is disposed in each of the slots 110 formed on the surface 104*a* of the fuser roller 104. Each wire member 118 has a first end 119 and a second end 120 which are fixed to the machine 100, or removable component 108 thereof if so configured, such that the paper 10 is prevented from wrapping around the fuser roller 104 by the wire members 118. The wire members 118 are illustrated as being connected to cross bars 105 of the frame 103 at points designated by reference character X.

The fuser roller 104 preferably has two slots 110, formed in its surface 104*a*, each slot 110 containing a corresponding wire member 118. In this configuration, the slots 110 are preferably spaced such that they are outside the area in which the image is imparted to the paper 10. For instance, in the case of a paper sheet, the slots 110 can be placed in the area which is typically used as a margin, such as within 1" of the edges of the paper. Similarly, in the case of an envelope, the slots 110 can be placed outside the area typically reserved for the recipients address but inside the area typically reserved for the return address.

Figure 2A:
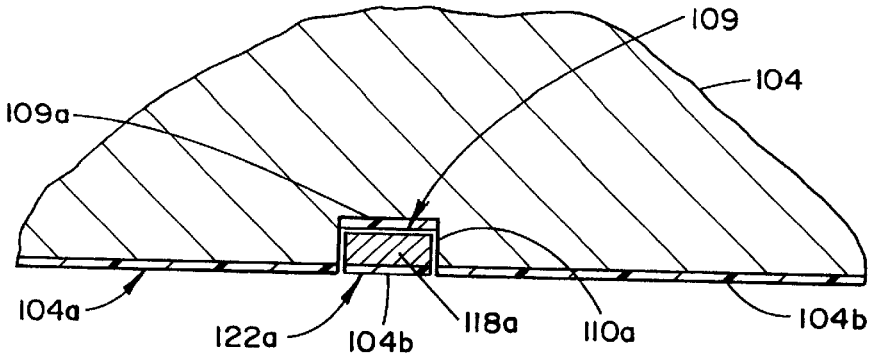
FIG. 2A illustrates a wire member having a rectangular cross-section disposed in a substantially conforming shaped slot in the fuser roller.
Figure 2B:
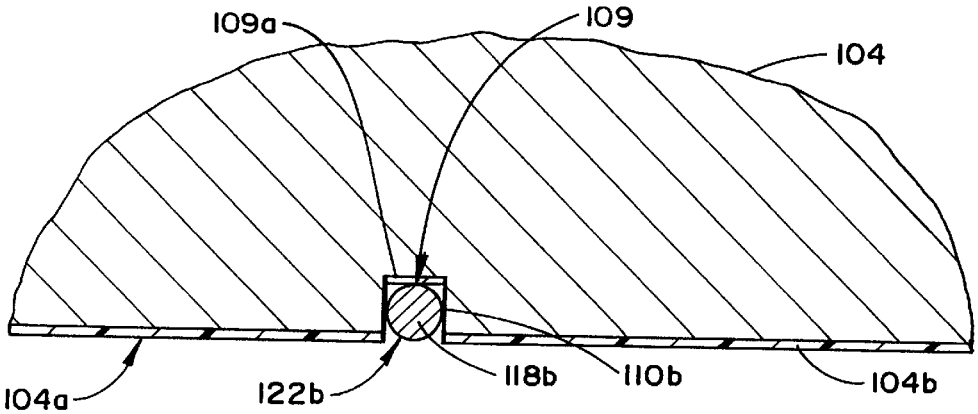
FIG. 2B illustrates a wire member having a circular cross-section disposed in a substantially conforming shaped slot in the fuser roller.
Figure 2C:
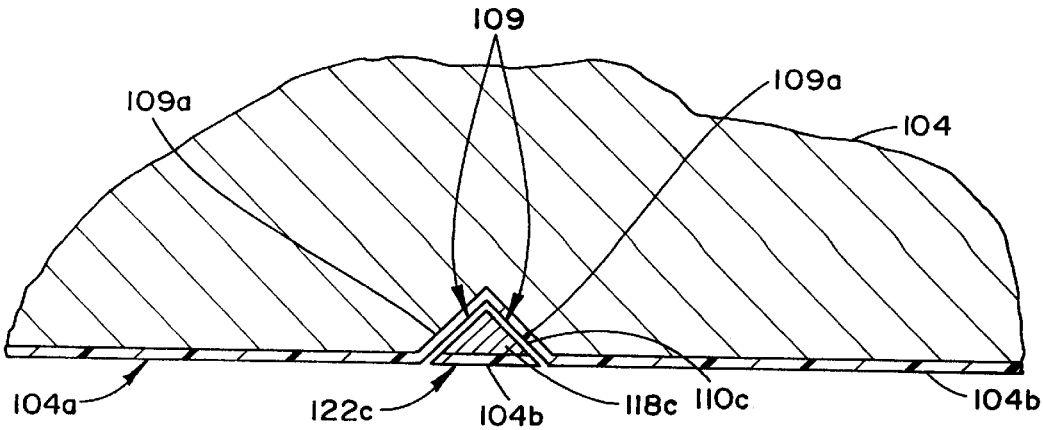
FIG. 2C illustrates a wire member having a triangular cross-section disposed in a substantially conforming shaped slot in the fuser roller.

Preferably the slot 110 is substantially the same depth as the thickness of the wire member such that a surface 122*a–c* of each wire member 118 is flush with the surface 104*a* of the fuser roller 104, as seen more clearly in FIGS. 2A–2C.

Referring now to FIG. 2A, in a first variation of fuser stripper apparatus 102 of the present invention, the wire members 118*a* are rectangular in cross-section. The corresponding slot 110*a* preferably conforms to the rectangular cross-sectional shape of each corresponding wire member 118*a*. Preferably, to improve the print quality in the area of the fuser roller 104 corresponding to the wire members 118*a*, the surface 122*a* of each wire member 118*a* that is flush with the surface 104*a* of the fuser roller 104 is treated with the coating 104*b* for effecting the impartation of the image to the paper 10. The rectangular cross-section wire members 118*a* are preferably thin sheet metal strips and are fixed to the machine 100 or removable component 108 by conventional ways known in the art, such as by spot welding.

Referring now to FIG. 2B, in a second variation of fuser stripper apparatus 102 of the present invention, the wire members 118*b* are circular in cross-section. The corresponding slot 110*b* preferably conforms to the circular cross-sectional shape of each corresponding wire member 118*a*, such as having a square cross-sectional shape 110*b*, or having rounded corners (not shown) corresponding to the radius of the circular cross-section wire member 118*b*. In such a configuration, the wire member 118*b* has a surface 122*b* flush with the surface 104*a* of the fuser roller 104. The circular cross-section wire member 118*b* is preferably a thin metal wire. The circular cross-section wire members 118*b* are fixed to the machine 100 or removable component thereof 108 by any means known in the art, such as by spot welding or threading the first and second ends 119, 120 into a corresponding bore (not shown) and crimping the ends to prevent the ends from coming out of the bores.

Referring now to FIG. 2C, in a Third variation of fuser stripper apparatus 102 of the present invention, the wire members 118*c* are triangular in cross-section. The corresponding slot 110*c* preferably conforms to the triangular cross-sectional shape of each corresponding wire member 118*c*. It should be apparent to those skilled in the art, that the triangular shaped wire member 118*c* and corresponding slot 110*c* allows the wire member 118*c* to self align in the slot 110*c* and is thus unlikely to work itself out of the slot 110*c*. Preferably, to improve the print quality in the area of the fuser roller 104 corresponding to the wire members 118*c*, the surface 122*c* of each wire member 118*c* that is flush with the surface 104*a* of the fuser roller 104 is treated with the coating 104*b* for effecting the impartation of the image to the paper 10. The triangular cross-section wire members 118*c* are preferably metal wires formed in the triangular shape by any methods known in the art, such as by extrusion. Like the other shaped wire members discussed above, the triangular cross-section wire members 118*c* are fixed to the machine 100 or removable component 108 by conventional ways known in the art, such as by spot welding.

To reduce the frictional force between a bottom surface(s) 109 of the slot 110 and the wire member 118, the bottom surface 109 of the slot 110 can be coated with a low friction coating 109*a*, such as Teflon to reduce any frictional force due to the rubbing contact between the bottom surface 109 of the slot 110 and the wire member 118. Additionally, or alternatively, a bottom surface of the wire member 118 corresponding to the bottom surface 109 of the slot 110 can be coated with a low friction coating.

Figure 3B:
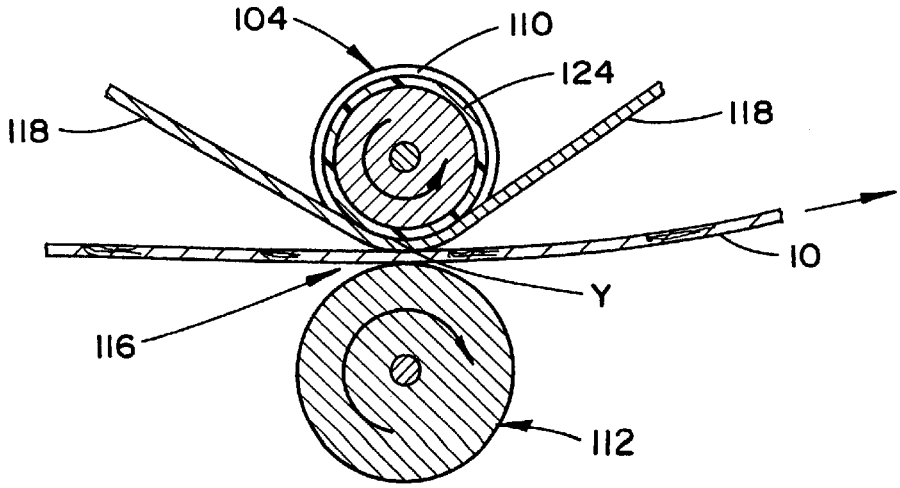
FIG. 3B illustrates a sectional view showing the fuser and idler rollers of the fuser stripper apparatus of FIG. 1 and having a rotatable ring fixed to the wire member.

Referring now to FIG. 3B, there is shown a further alternative variation of the present invention for reducing any frictional force due to rubbing contact between the bottom surface 109 of the slot 110 and the wire member 110. In this variation, a rotatable ring 124 is rotatably disposed in each slot 110. The ring 124 is sized such that it freely rotates in the slot 110. Each wire member 118 is fixed to the rotatable ring 124 such that as the fuser roller 104 rotates, the rotatable ring 124 rotates with it. Thus, rubbing contact between the wire member 118 and the slot 110 is eliminated.

The rotatable ring 124 is preferably made of a low friction material such as a Teflon coated metal or a low friction plastic such as Teflon or nylon. The wire member 118 is fixed to the rotatable ring 124 at a single point, designated by reference character Y, by any means known in the art, such as by spot welding (if the rotatable ring 124 is metallic) or with a pin (not shown) disposed in corresponding bores (not shown) in the wire member 118 and rotatable ring 110 (if the rotatable ring 124 is plastic).

Figure 4:
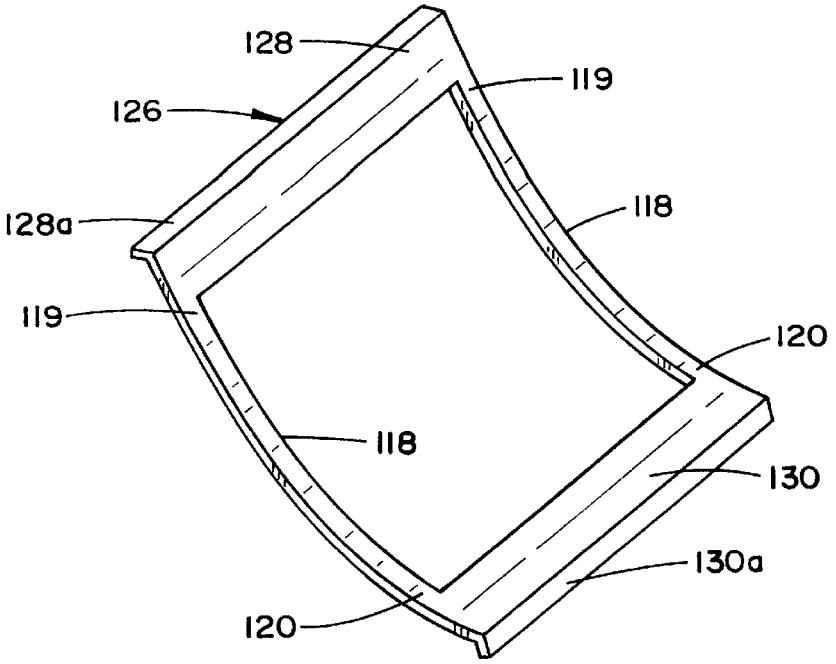
FIG. 4 illustrates two wire members integrally formed from a sheet of material.
Figure 5:
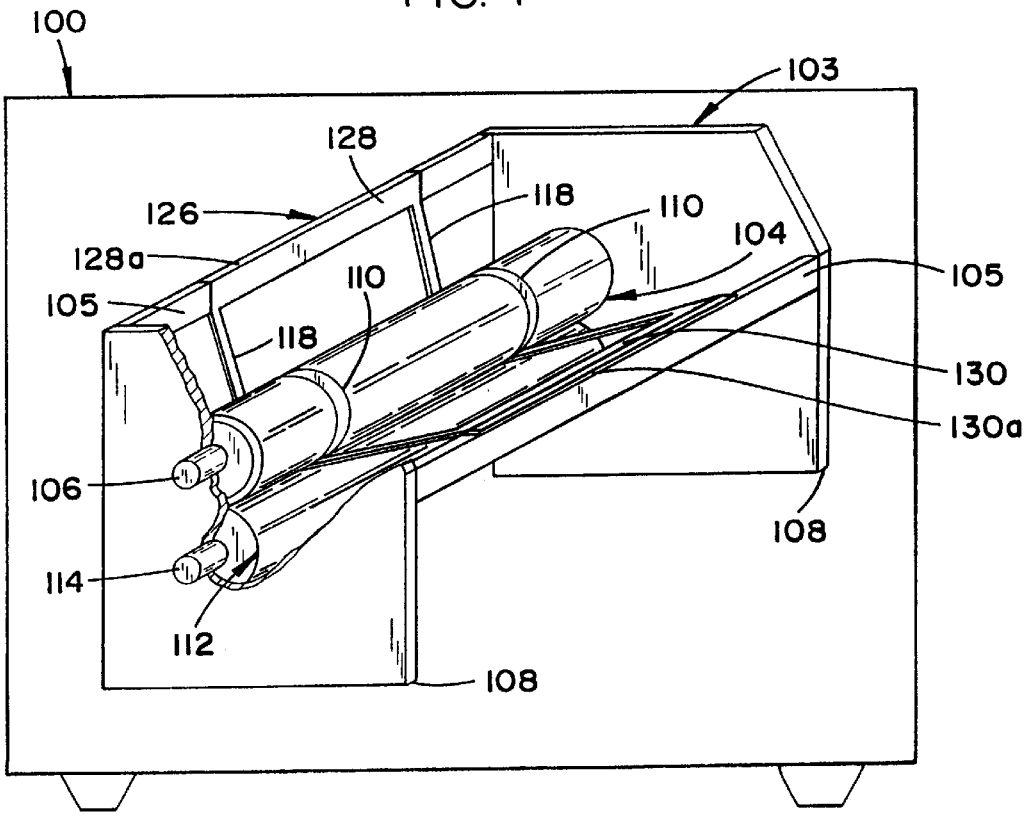
FIG. 5 illustrates a fuser stripper apparatus of the present invention wherein the wire members are fixed to a removable component of the machine and comprise the integrally formed sheet of FIG. 4.

Referring now to FIGS. 4 and 5, there is shown yet another variation of the present invention wherein the fuser roller 104 has two slots 110 formed in its surface. Each slot 110 has a wire member 118 disposed in it, wherein the wire members 118 are integrally formed from a single sheet 126. The sheet has first and second flanges 128, 130, respectively, connected to the first and second ends 119, 120 of the wire members 118. The first and second flanges 128, 130 are fixed to the machine 100, such as by spotwelding to the crossbars 105 of the frame 103. Alternatively, each of the first and second flanges 128, 130 can have a down-turned portion 128*a*, 130*a* adapted to fit the shape of the area of the crossbars 105 to which they will be spotwelded.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

I claim:

1. A fuser stripper apparatus for use in a machine which imparts an image to paper being fed therethrough, the apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for passage of the paper therein when either of the fuser or idler rollers are rotated;

means for rotating one of the fuser or nip rollers; and a wire member disposed in each of the at least one slot formed on the surface of the fuser roller, the wire member having first and second ends fixed to the machine such that the paper is prevented from wrapping around the fuser roller by the wire member, wherein each of the at least one slot is substantially the same depth as the thickness of the wire member.

2. The fuser stripper apparatus of claim 1, wherein the fuser roller is rotatably fixed in a removable component of the machine, wherein the first and second ends are fixed to the removable component.

3. The fuser stripper apparatus of claim 1, wherein the fuser roller has two slots formed in its surface, each of the at least one slot has a wire member disposed therein.

4. The fuser stripper apparatus of claim 3, wherein the wire members are spaced such that they are outside the area in which the image is imparted to the paper.

5. The fuser stripper apparatus of claim 1, further comprising a rotatable ring rotatably disposed in each of the at least one slot, wherein each wire member is fixed to a corresponding rotatable ring such that the rotatable ring rotates with the fuser roller thereby eliminating rubbing contact of the wire member with the slot.

6. The fuser stripper apparatus of claim 1, wherein each wire member is circular in cross-section.

7. The fuser stripper apparatus of claim 1, wherein each wire member is rectangular in cross-section.

8. The fuser stripper apparatus of claim 7, wherein each of the at least one slot substantially conforms to the rectangular cross-sectional shape of each corresponding wire member.

9. The fuser stripper apparatus of claim 7, wherein a surface of each wire member is flush with the surface of the fuser roller.

10. The fuser stripper apparatus of claim 7, wherein the fuser roller has two slots formed in its surface, the wire members disposed in each slot being integrally formed from a single sheet having first and second flanges connected to the first and second ends of the wire members, the first and second flanges being fixed to the machine.

11. The fuser stripper apparatus of claim 1, wherein the wire member is triangular in cross-section.

12. The fuser stripper apparatus of claim 11, wherein each slot substantially conforms to the triangular cross-sectional shape of each corresponding wire member.

13. The fuser stripper apparatus of claim 11, wherein a surface of each wire member is flush with the surface of the fuser roller.

14. The fuser stripper apparatus of claim 1, wherein the machine is a printer.

15. The fuser stripper apparatus of claim 1, wherein the machine is a photocopier.

16. The fuser stripper apparatus of claim 1, wherein the machine is a facsimile machine.

17. A printer having a fuser stripper apparatus which imparts an image to paper being fed therethrough the fuser stripper apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for the passage of the paper therein when either of the fuser or idler rollers are rotated;

means for rotating one of the fuser or nip rollers; and a wire member disposed in each of the at least one slot formed on the surface of the fuser roller, the wire member having first and second ends fixed to the machine such that the paper is prevented from wrapping around the fuser roller by the wire member, wherein each of the at least one slot is substantially the same depth as the thickness of the wire member.

18. A photocopier having a fuser stripper apparatus which imparts an image to paper being fed therethrough the fuser stripper apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for the passage of the paper therein when either of the fuser or idler rollers are rotated;

means for rotating one of the fuser or nip rollers; and a wire member disposed in each of the at least one slot formed on the surface of the fuser roller, the wire member having first and second ends fixed to the machine such that the paper is prevented from wrapping around the fuser roller by the wire member, wherein each of the at least one slot is substantially the same depth as the thickness of the wire member.

19. A facsimile machine having a fuser stripper apparatus which imparts an image to paper being fed therethrough the fuser stripper apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for the passage of the paper therein when either of the fuser or idler rollers are rotated;

means for rotating one of the fuser or nip rollers; and a wire member disposed in each of the at least one slot formed on the surface of the fuser roller, the wire member having first and second ends fixed to the machine such that the paper is prevented from wrapping around the fuser roller by the wire member, wherein each of the at least one slot is substantially the same depth as the thickness of the wire member.

20. A fuser stripper apparatus for use in a machine which imparts an image to paper being fed therethrough, the apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for passage of the paper therein when either of the fuser or idler rollers are rotated;

means for rotating one of the fuser or nip rollers; and a wire member, rectangular in cross-section, disposed in each of the at least one slot formed on the surface of the fuser roller, the wire member having first and second ends fixed to the machine such that the paper is prevented from wrapping around the fuser roller by the wire member, wherein each of the at least one slot substantially conforms to the rectangular cross-sectional shape of each corresponding wire member.

21. The fuser stripper apparatus of claim 20, wherein a surface of each wire member is flush with the surface of the fuser roller.

22. A fuser stripper apparatus for use in a machine which imparts an image to paper being fed therethrough, the apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for passage of the paper therein when either of the fuser or idler rollers are rotated;

means for rotating one of the fuser or nip rollers;

a wire member disposed in each of the at least one slot formed on the surface of the fuser roller, the wire member having first and second ends fixed to the machine such that the paper is prevented from wrapping around the fuser roller by the wire member; and a rotatable ring rotatably disposed in each of the at least one slot, wherein each wire member is fixed to a corresponding rotatable ring such that the rotatable ring rotates with the fuser roller thereby eliminating rubbing contact of the wire member with the slot.

23. A fuser stripper apparatus for use in a machine which imparts an image to paper being fed therethrough, the apparatus comprising:

a fuser roller rotatably fixed in the machine, the fuser roller having at least two slots formed in its surface;

an idler roller rotatably fixed in the machine and having a surface in substantial contact with the surface of the fuser roller thereby creating a nip for passage of the paper therein when either of the fuser or idler rollers are rotated;

means for rotating one of the fuser or nip rollers; and a wire member, rectangular in cross-section, disposed in each of the at least two slots formed on the surface of the fuser roller, each wire member having first and second ends fixed to the machine such that the paper is prevented from wrapping around the fuser roller by the wire members, wherein each of the at least two slots substantially conform to the rectangular cross-sectional shape of each corresponding wire member, wherein the wire members disposed in each slot being integrally formed from a single sheet having first and second flanges connected to the first and second ends of the wire members, the first and second flanges being fixed to the machine.

24. A fuser stripper apparatus for use in a machine which imparts an image to paper being fed therethrough, the apparatus comprising:

a fuser roller rotatably fixed in the machine, the fuser roller having at least one slot formed in its surface;

an idler roller rotatably fixed in the machine and having a surface in substantial contact with the surface of the fuser roller thereby creating a nip for passage of the paper therein when either of the fuser or idler rollers are rotated;

means for rotating one of the fuser or nip rollers; and a wire member, triangular in cross-section, disposed in each of the at least one slot formed on the surface of the fuser roller, the wire member having first and second ends fixed to the machine such that the paper is prevented from wrapping around the fuser roller by the wire member.

25. The fuser stripper apparatus of claim 24, wherein each slot substantially conforms to the triangular cross-sectional shape of each corresponding wire member.

26. The fuser stripper apparatus of claim 24, wherein a surface of each wire member is flush with the surface of the fuser roller.

* * * * *